US006645038B2

(12) United States Patent
Trotto

(10) Patent No.: US 6,645,038 B2
(45) Date of Patent: Nov. 11, 2003

(54) TOY WITH FLEXIBLE LIGHT-TRANSMITTING ELEMENTS

(75) Inventor: Laureen A. Trotto, Newtown, CT (US)

(73) Assignee: Thin Air, LLC, Monroe, CT (US)

( * ) Notice: Subject to any disclaimer, the term of this patent is extended or adjusted under 35 U.S.C. 154(b) by 0 days.

(21) Appl. No.: 10/053,618

(22) Filed: Jan. 24, 2002

(65) Prior Publication Data

US 2003/0139114 A1 Jul. 24, 2003

(51) Int. Cl.[7] ..... A63H 33/00

(52) U.S. Cl. ..... 446/486; 446/485; 446/219; 446/118; 40/547

(58) Field of Search ..... 446/219, 485, 446/118, 486; 362/253, 808, 812; 40/547, 550; 434/407, 96–98

(56) References Cited

U.S. PATENT DOCUMENTS

| | | | | |
|---|---|---|---|---|
| 3,897,951 A | | 8/1975 | Morrison et al. | |
| 4,196,539 A | | 4/1980 | Speers | |
| 4,529,193 A | | 7/1985 | Kuhnsman | |
| 4,529,207 A | | 7/1985 | Iseki et al. | |
| 4,844,447 A | | 7/1989 | McKnight | |
| 5,029,861 A | | 7/1991 | Driska | |
| 5,057,051 A | | 10/1991 | Babicz | |
| 5,288,259 A | | 2/1994 | Konta et al. | |
| 5,310,376 A | * | 5/1994 | Mayuzumi et al. | 446/118 |
| 5,324,224 A | | 6/1994 | Anderson | |
| 5,391,105 A | | 2/1995 | Jones | |
| 5,536,195 A | * | 7/1996 | Stamos | 446/219 |
| 5,609,509 A | | 3/1997 | Stamos | |
| 5,791,965 A | | 8/1998 | Kim | |
| 5,876,262 A | | 3/1999 | Kelly | |
| 6,032,393 A | | 3/2000 | Maxim | |
| 6,238,261 B1 | | 5/2001 | Lang | |

OTHER PUBLICATIONS

Internet: http://biz.yahoo.com, Yahoo Finance, "Just in Time for Daylight Saving Time, Hasbro Brightens the Day with New LIT–BRITE CUBE", Oct. 23, 2002.*

Internet: http://www.hasbro.com, Hasbro, Inc., "Lite–Brite Light Loops", 2003.*

Internet: http://www.fao.com, FAO Schwarz, "Lite–Brite Cube", 2003.*

* cited by examiner

*Primary Examiner*—Derris H. Banks
*Assistant Examiner*—Urszula M Cegielnik
(74) *Attorney, Agent, or Firm*—Fish & Richardson P.C.

(57) ABSTRACT

A toy includes an at least partially translucent member. The member includes a flexible, elongate portion, and a first peg portion and a second peg portion on opposite ends of the elongate portion.

A toy includes a toy assembly and a flexible peg. The toy assembly includes a peg board having a plurality of spaced apertures extending therethrough and a light source positioned adjacent to the peg board. The flexible peg has at least one end dimensioned to be inserted into one of the apertures.

37 Claims, 2 Drawing Sheets

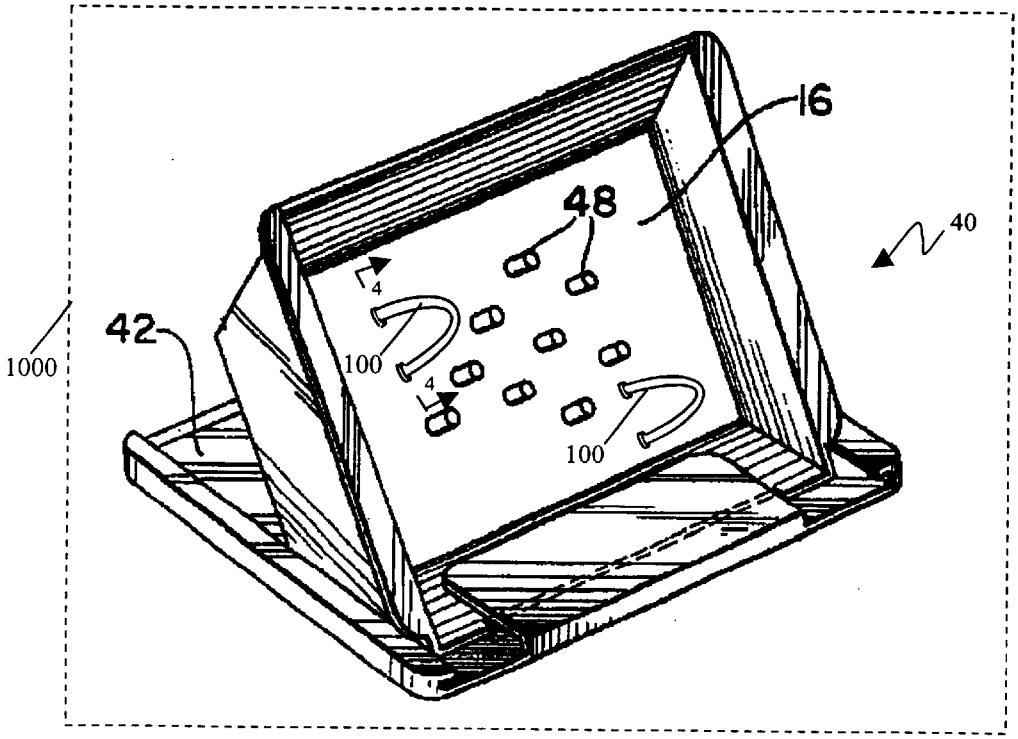
FIG. 3
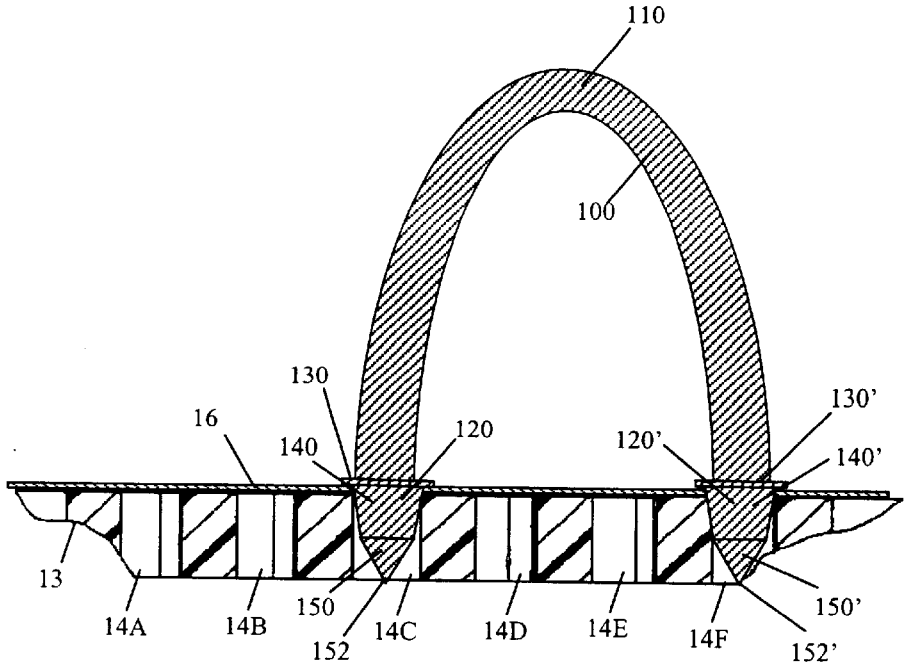
FIG. 4
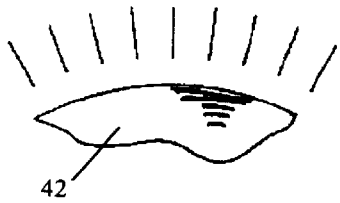

TOY WITH FLEXIBLE LIGHT-TRANSMITTING ELEMENTS

TECHNICAL FIELD

This invention relates to a toy and particularly one in which flexible loops may be assembled in various patterns or pictures on a board or other surface.

BACKGROUND

LITE BRITE®, a well-known toy, includes a board that defines an array of apertures, each capable of receiving a peg. Light from a source behind the board is transmitted through received pegs so as to enhance the appearance of designs or pictures formed using the pegs. This toy has been popular for many years.

SUMMARY

In one general aspect, a toy includes a member that is at least partially translucent. The member includes a flexible, elongate portion with two ends, having a first peg portion extending from a first end and a second peg portion extending from a second end.

Implementations may include one or more of the following features. For example, the first peg portion and the second peg portion each may include an insertion stop configured to stop insertion of the peg portion through an aperture while allowing at least partial insertion of the peg portion into the aperture. The insertion stop may include a protrusion extending from the peg portion. The protrusion may have a dimension greater than 3/16 of an inch. In particular, the protrusion may include an annular ring extending radially outward from a radially symmetric peg portion, and the ring may have a diameter greater than 3/16 of an inch.

The first peg portion and the second peg portion each may terminate in a tip. The tip may include a portion of a sphere with a radius of less than 1/8 of an inch.

The elongate portion may be a rod. The elongate portion may be made from a polymer.

The member may be of unitary construction. The member also may be transparent.

In another general aspect, a toy includes a flexible member having a first end and a second end. The first end includes an insertion stop configured to stop insertion of the first end into an aperture while allowing at least partial insertion of the first end into the aperture. The member is at least partially translucent.

Implementations may include one or more of the features noted above and one or more of the following features. For example, the second end may include a second insertion stop configured to stop insertion of the second end into an aperture while allowing at least partial insertion of the second end into the aperture.

In another general aspect, a toy includes a toy assembly and a flexible peg. The toy assembly includes a peg board having spaced apertures extending therethrough and a light source positioned adjacent to the peg board. The flexible peg has at least one end dimensioned to be inserted into one of the apertures. Implementations may include one or more of the features noted above.

The toy allows a child or other user to creatively interconnect apertures using peg elements with a pliable three-dimensional structure. This increases both the intellectual challenge to the child or other user and the types of images or patterns that may be formed.

The details of one or more implementations are set forth in the accompanying drawings and the description below. Other features and advantages will be apparent from the description and drawings, and from the claims.

DESCRIPTION OF DRAWINGS

FIG. 3 illustrates a kit including a toy assembly and two lite loops.

FIG. 4 is a sectional view of the toy assembly and light loop taken along line 4—4 of FIG. 3.

Like reference symbols in the various drawings indicate like elements.

DETAILED DESCRIPTION

Figure 1A:
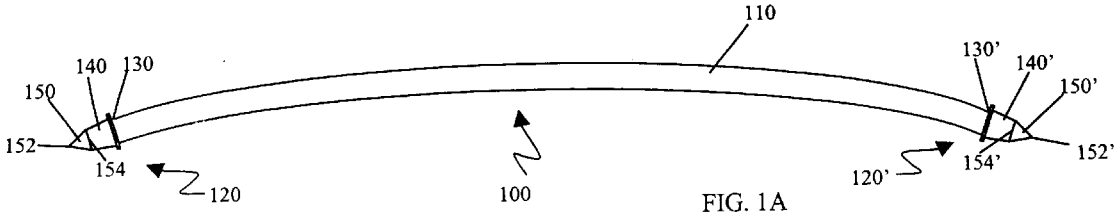
FIGS. 1A and 1B illustrate a flexible lite loop.
Figure 1B:
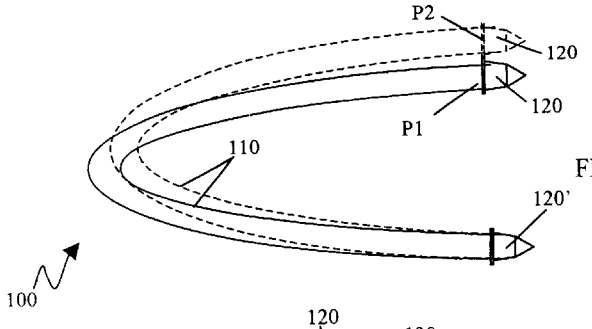

Referring to FIGS. 1A and 1B, a light loop 100 includes an elongate central member 110 joining a pair of peg portions 120, 120'. Central member 110 is a flexible rod, allowing a child or other user to move peg portion 120 from a first position P1 to a second position P2 without breakage of light loop 100 or movement of peg portion 120'. As discussed further below, a user may insert peg portions 120, 120' into, for example, a selected pair of apertures in a board placed in front of a light source (not shown) to form a design or image. Typically, light loop 100 is at least partially translucent such that at least a portion of any light entering peg portions 120, 120' is transmitted along a portion of central member 110. Light loop 100 also can be transparent.

Figure 2:
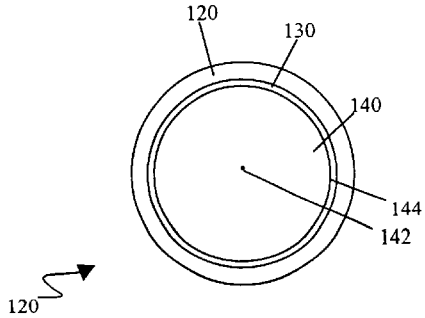
FIG. 2 illustrates an end-on view of a peg portion of the lite loop of FIG. 1A.

For the sake of brevity, both peg portions 120, 120' will be discussed in terms of peg portion 120. Referring also to FIG. 2, peg portion 120 includes an annular lip 130, a truncated conical shaft 140, and a terminal cone 150. Terminal cone 150 has a vertex 152 and a base 154. Vertex 152 forms a terminus of central member 110 and is a sufficiently stiff to allow a child to puncture a piece of construction paper covering an aperture with a diameter substantially the same as the median diameter of shaft 140. Terminal cone 150 joins to shaft 140 at base 154. Shaft 140 extends toward the center of central member 110. The diameter of shaft 140 increases in a direction toward the center of central member 110. Shaft 140 is joined to central member 110 by annular lip 130, which has a diameter greater than the largest diameter of shaft 140 and the diameter of central member 110.

Light loop 100 may be of unitary construction, made, for example, by injection molding PVC. The diameter of central member 110 may be, for example, between 1/2 and 1/8 of an inch. The diameter of annular lip 130 may be, for example, between 1/2 and 3/16 of an inch. The diameter of shaft 140 may, for example, vary linearly, between about 1/8 of an inch and about 5/32 of an inch over a length of about 1/8 of an inch. The diameter of terminal cone 150 may, for example, vary linearly, between about 1/16 of an inch and about 1/8 of an inch over a length of about 3/8 of an inch. Vertex 152 may be a half-sphere with a diameter, for example, less than 1/8 of an inch.

In one implementation, central member 110 has a diameter of 3/16 of an inch, annular lip 130 has a diameter of 1/4 of an inch, and vertex 152 is a half-sphere with a diameter of 1/16 of an inch.

Referring to FIGS. 3 and 4, a toy kit 1000 including a toy assembly 40 and light loops 100 is shown in the assembled state. Toy assembly 40 includes a cover 16 mounted on top of a board 13 in front of a light source 42. One or more pegs 48 may also be included in toy kit 1000. Board 13 defines an array of substantially circular apertures 14. Peg portions 120, 120' are dimensioned to be received in substantially circular apertures 14. Apertures 14 have diameters slightly larger than the largest diameter of shaft 140. Annular lip 130 thus limits the depth of insertion of light loop 100. Light source 42 may be, for example, a mirror as shown in FIG. 3 or a filament bulb as shown in FIG. 4. Planar board 13 may be entirely covered by cover 16, which may be a piece of black construction paper. A child or other user can select a first aperture 14 from the array, puncture cover 16 using vertex 152 of terminal cone 150 and insert peg portion 120 into the first aperture 14 by pushing light loop 100. The child or other user can then select a second aperture 14, flex central member 110 to align peg portion 120' with the second aperture 14, puncture cover 16 using vertex 152' of terminal cone 150', and insert peg portion 120' into second aperture 14 by pushing light loop 100. By flexing central member 110, a number of apertures 14 are available to act as a second aperture. Thus, a light loop 100 allows a child or other user to creatively interconnect apertures using a pliable three-dimensional structure. Individual pegs 48 may also be inserted into other apertures 14. This increases both the intellectual challenge to the child or other user and the types of images or patterns that may be formed.

Figure 5:
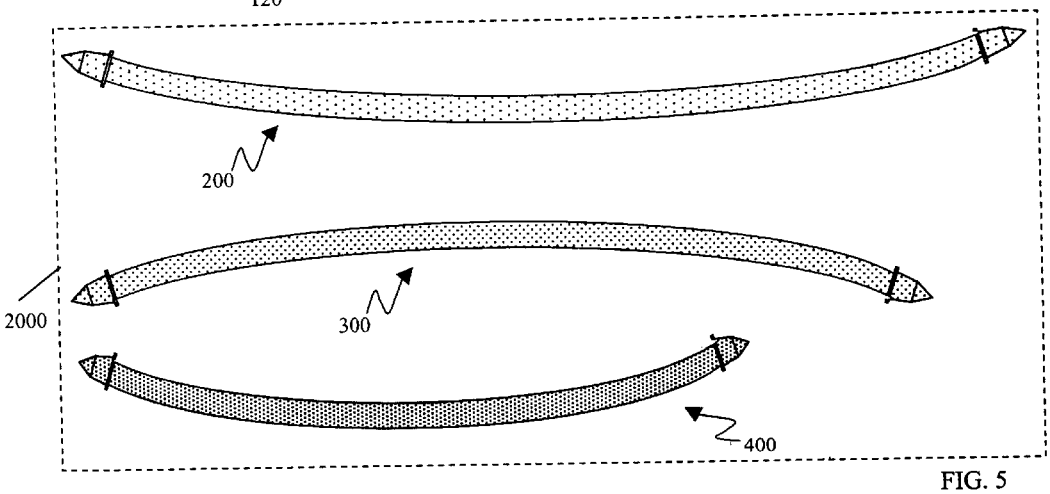
FIG. 5 illustrates a kit including alternate implementations of light loops.

Referring to FIG. 5, a toy kit 2000 includes light loops 200, 300, and 400. Light loops 200, 300, and 400 may be made having different colors, for example, by addition of an appropriate dye prior to injection molding. The dyes may be biocompatible. Dyeing is represented in FIG. 5 by the pixel density in each of light loops 200, 300, 400. Light loops 200, 300, 400 may be made red, orange, yellow, green, blue, indigo, or violet or shades and combinations thereof by selection of appropriate dyes and dye concentrations. Light loops 200, 300, 400 may also be made to sparkle by adding reflective particles during molding. Light loops 200, 300, 400 may also have different dyes and dye concentrations at different positions along their lengths.

Furthermore, light loops 200, 300, 400 may be made having different lengths. For example, the length of light loops 200, 300, 400 may be greater than about 3 inches and less than about 9 inches. The length of light loops 200, 300, 400 may be, for example, about 5 inches and about 7 inches.

As noted, light loop 100 typically is at least partially translucent such that at least a portion of any light entering peg portions 120, 120' is transmitted along a portion of central member 110. Light loop 100 may be transparent. Light transmission along central member 110 is a function of several factors, including the geometry of the junction between peg portions 120, 120' and central member 110, the transmission spectra of peg portions 120, 120' and central member 110, the emission spectrum of source 42, the refractive indices of peg portions 120, 120' and central member 110, and the flexion of central member 110. The influence of these and other factors is well understood and they may be tuned as desired. However, in general, at least a portion of the light entering peg portions 120, 120' is transmitted along central member 110 so as to enhance the appearance of designs or pictures formed using light loops.

Light loops may be packaged individually as shown in FIG. 1A, as toy kit 2000 including several different light loops 200, 300, 400 as shown in FIG. 5, or as toy kit 1000 including several light loops 100 and toy assembly 40, as shown in FIG. 3. Toy kits 1000, 2000 may include any of the light loops 100, 200, 300, 400 described herein. By providing light loops 100, 200, 300, 400 together, toy kit 2000 allows a consumer who already owns toy assembly 40 to form many types of designs or pictures using light loops. By providing light loops 100, 200, 300, 400 simultaneously with toy assembly 40, toy kit 1000 allows any consumer to make a single purchase and commence forming many types of designs or pictures using light loops.

A number of implementations have been described. Nevertheless, it will be understood that various modifications may be made. For example, annular lip 130 need not circumscribe the entire circumference of peg portion 120, and light loop 100 need not be of unitary construction. Accordingly, other implementations are within the scope of the following claims.

What is claimed is:

1. A toy comprising:

an at least partially translucent member including a flexible, elongate portion, and a first peg portion and a second peg portion on opposite ends of the elongate portion.

2. The toy according to claim 1 wherein the first peg portion and the second peg portion each comprise an insertion stop configured to stop insertion of the peg portion through an aperture while allowing at least partial insertion of the peg portion into the aperture.

3. The toy according to claim 2 wherein the insertion stop comprises a protrusion extending from the peg portion.

4. The toy according to claim 3 wherein the protrusion has a dimension greater than 3/16 of an inch.

5. The toy according to claim 3 wherein the protrusion comprises an annular ring extending radially outward from a radially symmetric peg portion.

6. The toy according to claim 5 wherein the ring has a diameter greater than 3/16 of an inch.

7. The toy according to claim 1 wherein the first peg portion and the second peg portion terminate in a tip.

8. The toy according to claim 7 wherein the tip comprises a portion of a sphere with a radius of less than 1/8 of an inch.

9. The toy according to claim 1 wherein the elongate portion comprises a rod.

10. The toy according to claim 1 wherein the elongate portion comprises a polymer.

11. The toy according to claim 1 wherein the at least partially translucent member is of unitary construction.

12. The toy according to claim 1 wherein the at least partially translucent member is transparent.

13. A toy comprising:

a flexible, at least partially translucent member having a first end and a second end, the first end including an insertion stop configured to stop insertion of the first end into an aperture while allowing at least partial insertion of the first end into the aperture.

14. The toy according to claim 13 wherein the insertion stop comprises a protrusion extending from the first end.

15. The toy according to claim 14 wherein the protrusion has a dimension greater than 3/16 of an inch.

16. The toy according to claim 14 wherein the protrusion comprises an annular ring extending radially outward from a radially symmetric peg portion.

17. The toy according to claim 16 wherein the ring has a diameter greater than 3/16 of an inch.

18. The toy according to claim 13 wherein the second end includes a second insertion stop configured to stop insertion of the second end into an aperture while allowing at least partial insertion of the second end into the aperture.

19. The toy according to claim 13 wherein the first end and the second end terminate in a tip.

20. The toy according to claim 19 wherein the tip comprises a portion of a sphere with a radius of less than ⅛ of an inch.

21. The toy according to claim 13 wherein the member comprises a rod.

22. The toy according to claim 13 wherein the member comprises a polymer.

23. The toy according to claim 13 wherein the member is of unitary construction.

24. The toy according to claim 13 wherein the member is transparent.

25. A toy comprising:

a toy assembly comprising a peg board having a plurality of spaced apertures extending therethrough, and a light source positioned adjacent to the peg board; and a flexible peg having at least one end dimensioned to be inserted into one of the apertures.

26. The toy according to claim 25 wherein the flexible peg is at least partially translucent.

27. The toy according to claim 25 wherein the flexible peg includes an insertion stop configured to stop insertion of the flexible peg into an aperture while allowing at least partial insertion of the flexible peg into the aperture.

28. The toy according to claim 27 wherein the insertion stop comprises a protrusion extending laterally from the flexible peg.

29. The toy according to claim 28 wherein the protrusion has a dimension greater than 3⁄16 of an inch.

30. The toy according to claim 28 wherein the protrusion comprises an annular ring extending radially outward from a radially symmetric peg portion.

31. The toy according to claim 30 wherein the ring has a diameter greater than 3⁄16 of an inch.

32. The toy according to claim 25 wherein the flexible peg comprises:

a first end and a second end each dimensioned to be inserted into one of the apertures; and a flexible, elongate portion connecting the first end and the second end.

33. The toy according to claim 32 wherein the second end includes a second insertion stop configured to stop insertion of the second end into an aperture while allowing at least partial insertion of the second end into the aperture.

34. The toy according to claim 32 wherein the first end and the second end terminate in a tip.

35. The toy according to claim 25 wherein the peg comprises a polymer.

36. The toy according to claim 25 wherein the peg is of unitary construction.

37. The toy according to claim 25 wherein the peg is transparent.

* * * * *